US007720423B2

(12) United States Patent
Omata

(10) Patent No.: US 7,720,423 B2
(45) Date of Patent: May 18, 2010

(54) IMAGE HEATING APPARATUS INCLUDING A COOLER AND A SILOXANE-MODIFIED POLYIMIDE BELT THEREFOR

(75) Inventor: Haruhiko Omata, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 934 days.

(21) Appl. No.: 11/438,462

(22) Filed: May 23, 2006

(65) Prior Publication Data

US 2007/0122216 A1 May 31, 2007

(30) Foreign Application Priority Data

Jun. 1, 2005 (JP) ..... 2005-161294

(51) Int. Cl.
*G03G 15/20* (2006.01)

(52) U.S. Cl. ..... 399/329; 399/341

(58) Field of Classification Search ..... 399/329, 399/341, 324

See application file for complete search history.

(56) References Cited

U.S. PATENT DOCUMENTS 6,625,416 B1 * 9/2003 Badesha et al.
2002/0057934 A1 * 5/2002 Ishikawa et al. ..... 399/329
2004/0019664 A1 1/2004 Le et al.

FOREIGN PATENT DOCUMENTS

| | | |
|---|---|---|
| JP | 64-35452 | 2/1989 |
| JP | 4-216580 | 8/1992 |
| JP | 4-362679 | 12/1992 |
| JP | 5-216288 | 8/1993 |
| JP | 5-216322 | 8/1993 |
| JP | 2000-56602 | 2/2000 |
| JP | 2001-331043 | 11/2001 |
| JP | 2003-084477 | 3/2003 |
| JP | 2003-084599 | 3/2003 |
| JP | 2004-151269 | 5/2004 |
| JP | 2004-198844 | 7/2004 |

* cited by examiner

*Primary Examiner*—David M Gray
*Assistant Examiner*—Laura K Roth
(74) *Attorney, Agent, or Firm*—Fitzpatrick, Cella, Harper & Scinto

(57) ABSTRACT

An image heating apparatus is provided for heating an image formed on a recording material having a resin material layer at an image formation side thereof. The apparatus includes a belt for closely contacting and heating an image on the recording material to provide a high glossiness image, and a cooler for cooling the recording material heated by the belt. The belt comprises a layer of siloxane-modified polyimide and has a thermal expansion coefficient of not less than $6\times10^{-5}/°$ C. and not more than $10\times10^{-5}/°$ C.

8 Claims, 5 Drawing Sheets

IMAGE HEATING APPARATUS INCLUDING A COOLER AND A SILOXANE-MODIFIED POLYIMIDE BELT THEREFOR

FIELD OF THE INVENTION AND RELATED ART

The present invention relates to an image heating apparatus for heating an image on recording medium, and a belt for an image heating apparatus. The image heating apparatus and the belt therefor are employed by an image forming apparatus such as a copying machine, a printer, facsimile machine, etc.

In the field of an image forming apparatus, an image forming apparatus, such as a copying machine, a printer, facsimile machine, etc., which employs an electrophotographic image forming method, has widely been known. Further, various image forming apparatuses capable of forming a full-color image in addition to a black-and-white image have been commercialized. As the usage of an image forming apparatus has spread into various fields, the image quality required of an electrophotographic image forming apparatus has become substantially higher. Here, one of the essential properties of an image, which affects the quality of the image, is the uniformity of the image in terms of glossiness. That is, the more uniform in glossiness the full-color image, the higher it appears in quality. Therefore, it has been desired to improve an electrophotographic image forming apparatus in terms of the level of uniformity in glossiness at which it forms an image. The smoothness of an image can be listed as one of the image properties which determine the level of the glossiness of the image.

In response to the above described needs, the following image forming apparatus has been proposed by Japanese Laid-open Patent Applications 64-35452 and 05-216322. That is, this image forming apparatus uses recording medium provided with a transparent resin layer, as a toner receiving layer, formed of a thermoplastic resin. Further, the image forming apparatus is structured to form a color image by transferring color toners made up of thermoplastic resin, onto the recording medium provided with the toner receiving transparent layer formed of thermoplastic resin, and then, heating and melting the color toners.

As the preferable fixing apparatus for the above described image forming method, a fixing apparatus, which employs a fixation belt, and cools recording medium before separating the recording medium from the fixation belt, has been proposed in Japanese Laid-open Patent Applications 04-216580 and 04-362679 (this fixing apparatus hereafter may be referred to belt-based fixing apparatus). More specifically, according to these patent applications, a recording medium bearing an unfixed toner image is pressed and heated, along with the unfixed toner image, by a fixation belt formed of heat resistant film. Then, the toner image on the recording medium is solidified by cooling the recording medium, with the recording medium kept thoroughly in contact with the fixation belt. Then, the recording medium to which the toner image has just been fixed is peeled away from the fixation belt. Thus, the toner image is embedded in the transparent resin layer as it is fixed to the recording medium. Therefore, as the toner becomes fixed to the recording medium, the top surface of the toner image becomes level with the top surface of the transparent resin layer. In other words, the toner image bearing surface of the recording medium becomes smooth across its entirety; a color image which is excellent in glossiness can be obtained.

A recording medium, such as the above described one, which is provided with the resin layer, and is used with an image forming apparatus, such as the above described one, is also proposed in Japanese Laid-open Patent Application 2003-084477.

However, it became evident that as an unfixed toner on the above described recording medium having the toner image receiving transparent resin layer is fixed by a belt-based fixing apparatus, in accordance with the prior art, which cools recording medium before separating the recording medium from its fixation belt, the toner image is minutely disturbed, becoming rougher in appearance than before it was fixed.

The detailed studies of the tests of the image heating apparatuses in accordance with the prior art by the inventors of the present invention made it possible to theorize that the following mechanism was responsible for the above described phenomenon.

That is, a belt-based fixing apparatus, which cools recording medium before separating the recording medium from its fixation belt, is structured so that a toner image on a recording medium having a transparent resin layer is heated together with the transparent resin layer of the recording medium while being kept thoroughly in contact with the fixation belt, and also, so that the recording medium is separated from the fixation belt after being cooled. Thus, the above described problematic phenomenon is attributable to these sequential processes of heating and cooling.

More specifically, because of the changes in temperature which occur between the heating process and cooling process, the fixation belt expands first, and then, contracts, along with the recording medium (in particular, transparent resin layer thereof). In addition, in the case of a fixing apparatus in accordance with the prior art, its fixation belt is substantially different in coefficient of thermal expansion from the recording medium (in particular, transparent resin layer thereof) it uses. Therefore, the toner image on the recording medium, and the transparent resin layer of the recording medium, are pulled by the fixation belt. As a result, the toner image becomes disturbed.

SUMMARY OF THE INVENTION

The primary object of the present invention is to provide an image heating apparatus which does not contributes to the occurrences of image defects, and a belt for heating an image.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

(1) Example of Image Forming Apparatus

Figure 1:
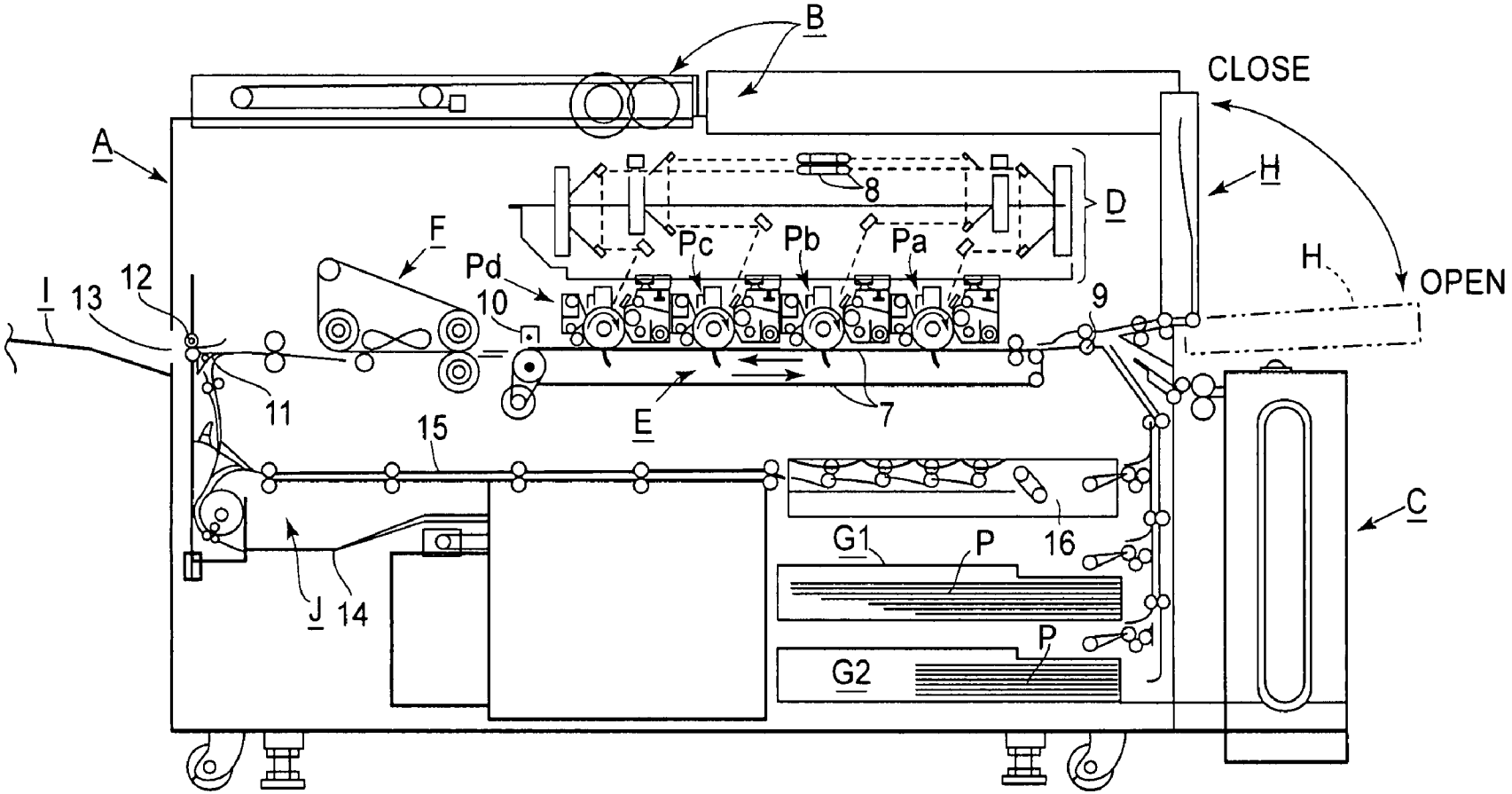
FIG. 1 is a schematic view of an example of a preferable image forming apparatus in which a fixing apparatus in accordance with the present invention is mountable, showing the general structure the image forming apparatus.

FIG. 1 is a schematic view of an example of a preferable image forming apparatus in which a fixing apparatus in accordance with the present invention is mountable, showing the general structure of the image forming apparatus.

The image forming apparatus in this embodiment is a full-color laser beam printer which uses an electrophotographic image formation process. It is based on four primary color components. Designated by a referential symbol A is the main assembly of the printer, and designated by a referential symbol B is an image reading mechanism, which is disposed on the top side of the main assembly A. Designated by a referential symbol C is a sheet feeding apparatus of a large capacity, which is disposed next to the right-hand side (in FIG. 1) of the printer main assembly A, being connected to the main assembly A.

Designated by referential symbols Pa, Pb, Pc, and Pd are first to fourth image forming portions, which are located in the printer main assembly A, being horizontally stacked in parallel (inline structure; tandem structure), listing from right to left in the drawing. Designated by a referential symbol D is a laser scanner disposed immediately above the first to fourth image forming portions Pa, Pb, Pc, and Pd. The laser scanner D has multiple optical scanning means. Designated by a referential symbol E is a transfer belt mechanism disposed immediately below the first and fourth image forming portions Pa, Pb, Pc, and Pd. Designated by a referential symbol F is a fixing apparatus, which is disposed on the downstream side of the transfer belt mechanism E in terms of the recording medium conveyance direction. Designated by referential G1 and G2 are first and second sheet feeder cassettes removably mounted in the printer main assembly A. The first and second sheet feeder cassettes G1 and G2 are vertically stacked below the transfer belt mechanism E. Designated by a referential symbol H is an external manual sheet feeder tray attached to the top right side (in FIG. 1) of the printer main assembly A. When this manual sheet feeder tray H is not needed, it can be stored away by being folded flat against the printer main assemble A as contoured by the solid line in the drawing. When it is needed, it is opened as contoured by the double-dot chain line.

The image reading mechanism B reads an original. That is, it obtains the information necessary to form a copy of an original, which in this case is a full-color image, by separating the optical image of a full-color original into multiple monochromatic optical images different in color (in terms of preset color components) with the use of a photoelectric transducer (solid-state photographic element) such as a CCD.

The laser scanner D projects a beam of laser light to the first to fourth image forming portions while modulating the beam of laser light with the abovementioned image formation information obtained by separating the optical image of the original.

Figure 2:
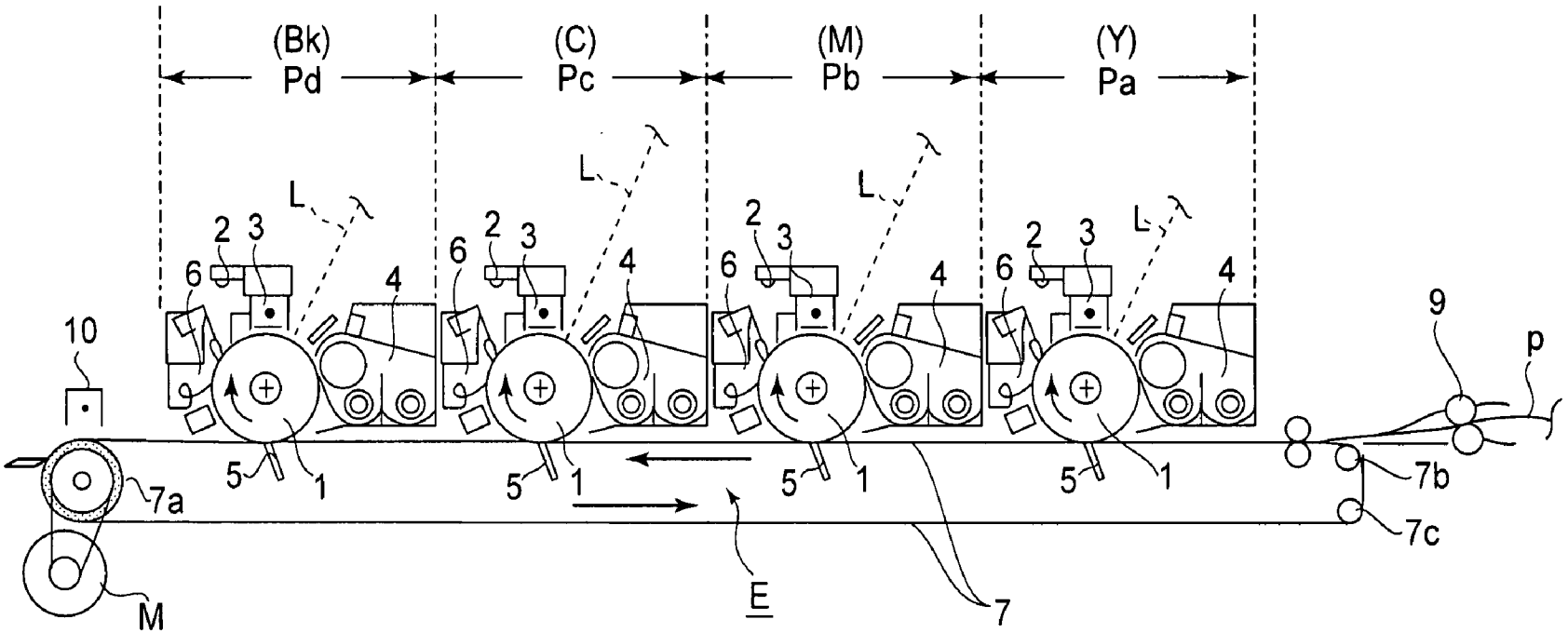
FIG. 2 is an enlarged view of the first to fourth image forming portions and transfer belt mechanism portion of the image forming apparatus.

FIG. 2 is an enlarged view of the first to fourth image forming portions Pa, Pb, Pc, and Pd and transfer belt mechanism E of the image forming apparatus. The first to fourth image forming portions Pa, Pb, Pc, and Pd are identical in structure. That is, each image forming portion has an electrophotographic photosensitive drum 1 (which hereinafter will be referred to as photosensitive drum), and processing means, such as a full-exposure lamp 2 (charge removal lamp), a primary charging device 3, a developing device 4, a transfer charging device 5, a cleaner 6, etc., for processing the photosensitive drum 1. The four developing devices 4 in the first to fourth image forming portions Pa, Pb, Pc, and Pd are supplied with preset amounts of yellow, magenta, cyan, and black toners, by their own toner supplying apparatuses, respectively.

The transfer belt mechanism E has an endless transfer belt 7, a driver roller 7*a*, and a pair of turn rollers 7*b* and 7*c*. The transfer belt 7 is stretched around these rollers 7*a*, 7*b*, and 7*c*, being suspended by the rollers. As the driving roller 7*a* is rotated by a motor M through a power transmitting apparatus such as a timing belt, the transfer belt 7 is circularly moved in the counterclockwise direction indicated by an arrow mark at a preset velocity. As the transfer belt 7, a belt formed of a sheet of dielectric substance such as polyethylene terephthalate (PET), polyvinylidene fluoride, polyurethane, or the like, by bonding the opposing edges of the sheet in an overlapping manner, or a seamless belt formed of one of the abovementioned substances, is employed.

The operation carried out by the above described image forming apparatus is as follows. That is, the first to fourth image forming portions Pa, Pb, Pc, and Pd are sequentially driven with preset image formation timing. As each image forming portion is driven, its photosensitive drum 1 rotates in the clockwise direction indicated by an arrow mark. At the same time, the transfer belt 7 of the transfer belt mechanism E is circularly moved, and the laser scanner is driven. In synchronism with the driving of these components, the primary charging device 3 uniformly charges the peripheral surface of the photosensitive drum 1 to preset polarity and potential level. The laser scanner D scans (exposes) the charged peripheral surface of each photosensitive drum 1 with the beam of laser light which it projects while modulating the beam with video signals. As a result, an electrostatic latent image, which reflects the video signals, is formed on the peripheral surface of each photosensitive drum 1. More specifically, the beam of laser light emitted from the light source of the laser scanner D is deflected by a polygon mirror 8, which is being rotated. Thus, the beam of laser light is deflected in an oscillatory manner. This oscillatory beam of laser light is deflected by a refection mirror, and focused on the peripheral surface of the photosensitive drum 1 by an f-θ lens, selectively exposing numerous points of the peripheral surface of the photosensitive drum 1. As a result, an electrostatic latent image, which reflects the video signals, is effected on the peripheral surface of the photosensitive drum 1. This electrostatic latent image is developed into a toner image, that is, a visible image formed of toner, by the developing device 4.

Through the above described electrophotographic image formation process, a monochromatic yellow toner image for forming a full-color image is formed on the peripheral surface of the photosensitive drum 1 of the first image forming portion Pa. On the peripheral surface of the photosensitive drum 1 of the second image forming portion Pb, a monochromatic magenta toner image for forming a full-color image is formed. On the peripheral surface of the photosensitive drum 1 of the third image forming portion Pc, a monochromatic cyan toner image for forming a full-color image is formed. Further, on the peripheral surface of the photosensitive drum 1 of the fourth image forming portion Pd, a black toner image for forming a full-color image is formed.

Meanwhile, the sheet feeding roller of the sheet feeding portion of the selected sheet feeding device among the sheet feeding apparatus C of a large capacity, first sheet feeder cassette G1, second sheet feeder cassette G2, and manual sheet feeder tray is driven, whereby one of the recording mediums P stored in layers in the sheet feeding portion of the selected sheet feeding device is separated from the rest, and is fed into the printer main assembly A. Then, the recording medium P is delivered to the transfer belt 7 of the transfer belt mechanism E by way of multiple conveyer rollers and a pair of registration rollers 9, and then, is borne on the transfer belt 7. After being borne on the transfer belt 7, the recording medium P is sequentially conveyed through the transfer portions of the first to fourth image forming portions Pa, Pb, Pc, and Pd.

More specifically, the transfer belt 7 is circularly driven by the driver roller 7*a* of the transfer belt mechanism E. As it is confirmed that the recording medium P is at a preset location, it is released and conveyed by the pair of registration rollers 9 toward the transfer belt 7, and then, is conveyed by the transfer belt 7 to the transfer portion of the first image forming portion Pa. At the same time, an image writing start signal is outputted to start forming an image on the photosensitive drum 1 of the first image forming portion Pa with certain timing set in response to the outputting of the image writing start signal. In the transfer portion, which is on the bottom side of the photosensitive drum 1, the yellow toner image, that is, the toner image of the first color, is transferred onto the recording medium P by the application of an electric field or electric charge by the transfer charging device 4. During this transferring process, the recording medium P is firmly held to the transfer belt 7 by electrostatic force, and then, is sequentially conveyed through the transfer portions of the second to fourth image forming portions Pb, Pc, and Pd. While the recording medium P is conveyed through the transfer portions of the second to fourth image forming portions Pb, Pc, and Pd, the magenta, cyan, and black toner images formed on the photosensitive drums 1 of the second to fourth image forming portions Pb, Pc, and Pd, respectively, are sequentially transferred in layers onto the recording medium P in a manner to be overlaid on the yellow toner image on the recording medium P. As a result, a single full-color image is synthetically formed on the recording medium P, of the four monochromatic toner images which are different in color.

After the synthetic formation of the single full-color image on the recording medium P, of the four monochromatic toner images different in color, the recording medium P is further conveyed by the transfer belt 7 to the separation charging device 10, which is located at the downstream end of the transfer belt 7. As the recording medium P is moved along the separation charging device 10, the electric charge is removed from the recording medium P, reducing thereby the amount of the electrostatic force which was keeping the recording medium P adhered to the recording medium P. Consequently, the recording medium P becomes separated from the transfer belt 7 at the downstream end of the span of the transfer belt 7.

Incidentally, in a low humidity ambience, the recording medium P dries, increasing in electric resistance. Therefore, the electrostatic force which keeps the recording medium P adhered to the transfer belt 7 is greater in a low humidity ambience. Therefore, the role of the separation charging device 10 is more important when ambient humidity is low. Normally, the separation charging device 10 removes electric charge from the recording medium P prior to the fixation of the unfixed toner images. Therefore, a noncontact charging device is employed as the separation charging device 10.

After being separated from the transfer belt 7, the recording medium P is conveyed to a fixing apparatus F. In the fixing apparatus F, the recording medium P and the toner images thereon are subjected to heat and pressure. As a result, the toner images, which are different in color, are fixed, while being mixed, to the recording medium P, yielding a permanent full-color copy.

After being conveyed out of the fixing apparatus F, the recording medium P is further conveyed to a selector 11. When the selected image formation mode for the image forming apparatus is the one-sided image formation mode, the recording medium P is conveyed on the top side of a selector 11, which is kept in the first attitude for the selector 11, and then, is discharged by a pair of sheet discharge rollers 12 through the sheet discharge opening 13 onto an external delivery tray I.

When the selected image formation mode for the image forming apparatus is the two-sided image formation mode, the recording medium P, bearing the full-color image fixed to one of the surfaces, is also conveyed to the selector 11 after being conveyed out of the fixing apparatus. In this mode, however, the selector 11 is kept in the second attitude. Therefore, the recording medium P is directed by the selector 11 toward a reversing-refeeding mechanism J, and then, is conveyed through the mechanism J. While the recording medium P is conveyed through the mechanism J, it is placed upside down by the reversing portion (switchback mechanism) of the reversing-refeeding mechanism J. Then, the recording medium P is conveyed into the sheet conveyance path 15 for the two-sided image formation mode, through which it is moved into an intermediary tray 16, in which it is temporarily stored. After being temporarily held in the intermediary tray 16, the recording medium P is moved out of the intermediary tray 16 by a feed roller which is driven with a preset control timing, and is conveyed toward the pair of registration rollers 9, which re-release the recording medium P with the preset timing toward the transfer belt 7. In this image formation mode, the recording medium P is borne on the transfer belt 7, with its second surface, or the surface not bearing a toner image, facing upward. Then, the recording medium P is sequentially conveyed through the first to fourth image forming portions Pa, Pb, Pc, and Pd as it was to form the toner images on the first surface of the recording medium P. As a result, a full-color image is synthetically formed on the second surface of the recording medium P, of the four monochromatic toner images of the four primary colors, one for one.

After receiving the four monochromatic toner images on the second surface, the recording medium P is separated from the transfer belt 7, and is conveyed to the fixing apparatus F, by which the toner images are fixed to the second surface of the recording medium P. Then, the recording medium P is conveyed to the top side of the selector 11, the attitude of which has been switched to the first attitude. Then, it is discharged, as a two-sided copy, by the pair of sheet discharge roller 12 through the sheet discharge opening 13 onto the delivery tray I.

This image forming apparatus is capable of outputting a black-and-white copy and monochromatic copy in addition to a full-color image. If the black-and-white or monochromatic image formation mode is selected, only the image forming portion which corresponds in color to the selected color is activated for image formation, among the first to fourth image forming portions Pa, Pb, Pc, and Pd, and the sequence for transferring a toner image onto the recording medium P while the recording medium is conveyed by the transfer belt mechanism E is carried out in the transfer portion of the image forming portion which corresponds in color to the selected color for the black-and-white or monochromatic image formation mode. Incidentally, the photosensitive drums in the rest of the image forming portions are also rotated. However, the image forming operation is not carried out in these image forming stations.

(2) Fixing Apparatus F

Figure 3:
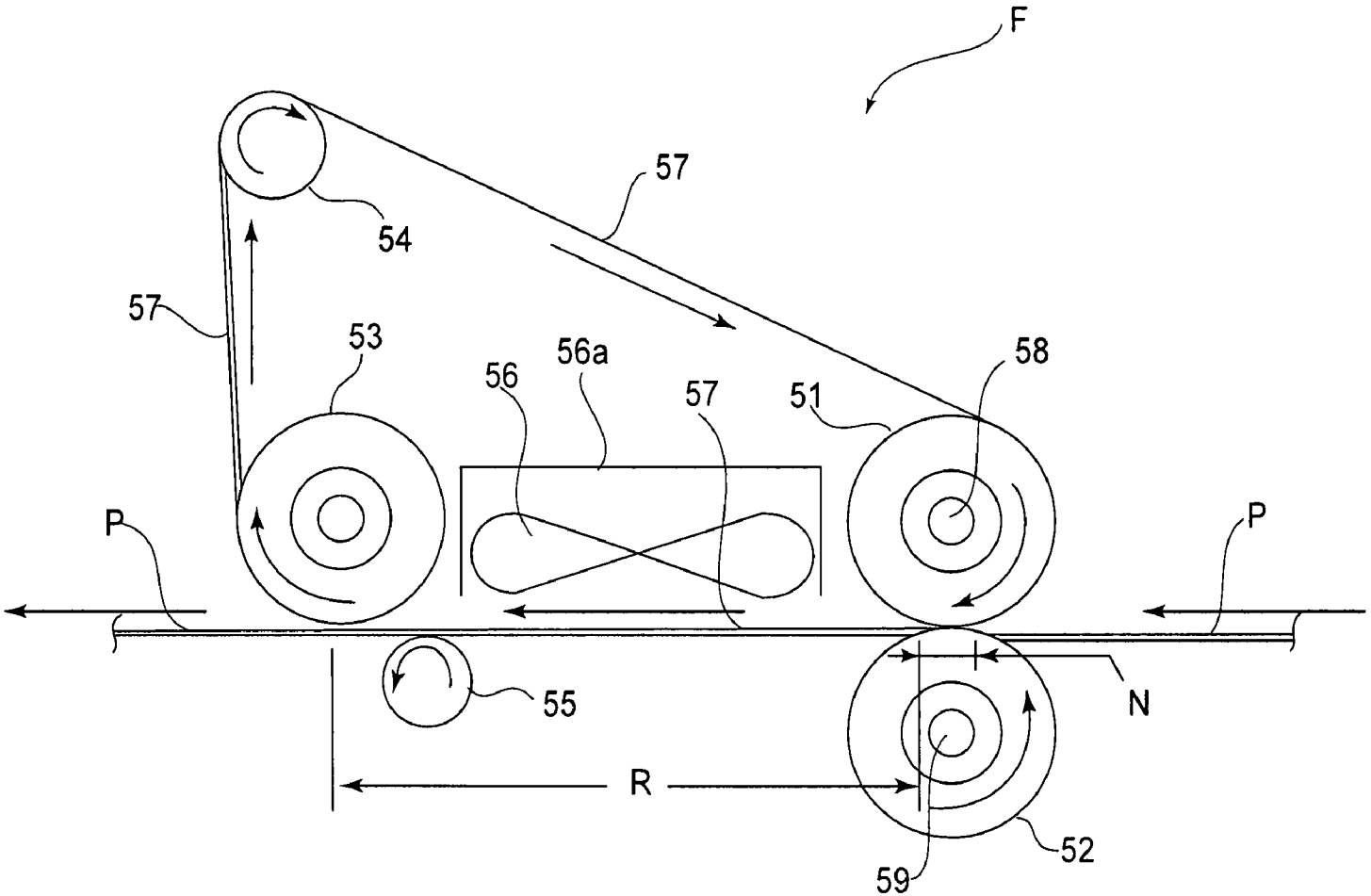
FIG. 3 is an enlarged schematic view of the fixing apparatus portion of the image forming apparatus.

FIG. 3 is a schematic enlarged view of the fixing apparatus F. The fixing apparatus F in this embodiment is a fixing device which employs a fixation belt. This fixing device F is made up of a fixation belt 57, a first fixation roller 51 (which hereafter will be referred to as fixation roller) as a heat roller, a rotational roller 53 (which hereafter will be referred to as separation roller) as a separation roller, a rotational roller 54 (which hereafter will be referred to as tension roller) as a tension roller. The separation roller 53 is disposed so that a preset amount of distance is maintained between the fixation roller 51 and separation roller 53. The tension roller 54 is disposed above the separation roller 53. The fixation belt 57, which is an endless belt, is stretched around these three rollers 51, 53, and 54, being thereby suspended by the three rollers. The fixing apparatus F is also provided with a second fixation roller 52 (which hereafter will be referred to as pressure roller) as a pressure application roller, which is kept pressed against the fixation roller 51 with the fixation belt 57 pinched between the fixation rollers 51 and 52. Further, the fixing apparatus F is provided with an auxiliary roller 55. In terms of the direction parallel to the recording medium bearing portion of the fixation belt 57, the auxiliary roller 5 is disposed between fixation roller 51 and separation roller 53, and near the separation roller 53. In terms of the loop which the fixation belt 57 forms, the auxiliary roller 55 is disposed in contact with the outward surface of the fixation belt 57. Moreover, the fixing apparatus F is provided with a cooling fan 56, as a cooling means which uses forced air as cooling medium. The cooling fan 56 is disposed between the fixation roller 51 and separation roller 53 in order to cool the portion of the fixation belt 57, which is between the fixation roller 51 and separation roller 53. The abovementioned fixation roller 51, pressure roller 52, separation roller 53, tension roller 54, and auxiliary roller 55 are disposed virtually in parallel.

The fixation roller 51 has three concentric cylindrical layers; it is made up of a core, an elastic layer, and a release layer. The core is a piece of hollow aluminum tube, which is 44 mm in diameter and 5 mm in thickness. The elastic layer is 50 degrees in JIS-A hardness scale, and 300 μm in thickness. It is formed of silicon rubber. The release layer is 50 μm in thickness and is formed of PFA. In the hollow of the core, a halogen lamp 58 as a heat source (roller heating heater) is disposed. Incidentally, the heat source does not need to be limited to a halogen heater. For example, a heating means based on electromagnetic induction may be employed so that the fixation roller 51 is heated by the heat generated in its wall by the electric current generated therein by the magnetic flux generated by an excitation coil.

The pressure roller 52 has the same structure as the fixation roller 51, except that its elastic layer is 3 mm in thickness so that a fixation nip is formed between the fixation roller 51 and pressure roller 52. Designated by a referential symbol 59 is a halogen heater as a heat source (roller heating heater) disposed in the hollow of the core of the pressure roller 52.

The fixation roller 51 and pressure roller 52 are kept pressed against each other with the application of a preset amount of pressure, with the fixation belt 57 pinched between the two rollers 51 and 52, forming thereby a fixation nip N, as a heat and pressure application portion, which has a preset width in terms of the recording medium conveyance direction. The total amount of pressure applied to the pressure roller 52 is 490 N (50 kgf). The width of the thus formed fixation nip N was 5 mm.

The surface hardness of the fixation roller 51 must be selected according to the properties of the fixation belt 57. If the fixation belt 57 is insufficient in surface hardness, the fixation belt 57 deforms, failing to fully embedding the toner into the toner receiving layer of the recording medium P. Thus, the top surfaces of the toner images on the recording medium does not become level with the portions of the toner image receiving layer, which surround the toner images. However, when the fixation belt 57 is insufficient in hardness, the fixation roller 51 may be rendered hard enough to satisfactorily embed the toner images. As the method for rendering the fixation roller 51 harder, its elastic layer may be reduced in the thickness, or eliminated, leaving only the surface layer formed of PFA. Further, both the elastic layer and release layer may be eliminated; a piece of plain aluminum cylinder may be used as the fixation roller 51.

Figure 5:
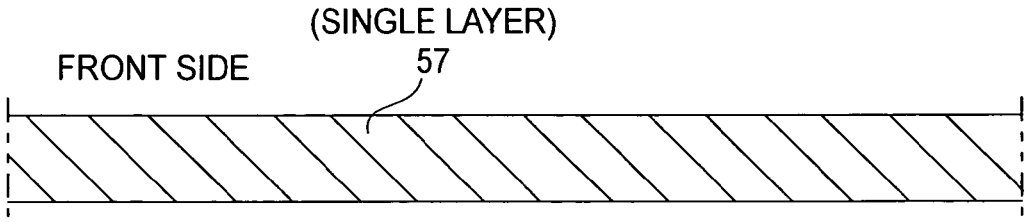
FIG. 5 is a schematic sectional view of the fixation belt in the first embodiment of the present invention.

The fixation belt 57 in this embodiment is a mono-layer belt 57, and is formed of siloxane-modified polyimide. FIG. 5 is a sectional view of this belt. The belt surface (which is placed thoroughly in contact with image formed on recording medium) is polished, like the surface of a mirror, to yield a high gloss image; the surface of the transfer belt 57, which contacts the toner images, is polished smooth. Incidentally, the specular glossiness (smoothness) of the belt surface can be measured by a hand-held gloss meter PG-1M (product of Nippon Denshoku Kogyo Co., Ltd.). In this embodiment, it is 60°. The measurement of the glossiness of the fixation belt 57 is in accordance with JIS Z 8741. In this embodiment, the glossiness of the fixation belt 57 is desired to be no less than 80 and no more than 110. As long as the glossiness of the fixation belt 57 is in this range, it is possible to yield an excellent high gloss image.

The fixation roller 51 is rotated by an unshown driving mechanism at a preset velocity in the clockwise direction indicated by an arrow mark. As the fixation roller 51 is rotated, the fixation belt 57 is circularly moved by the fixation roller 51 in the clockwise direction indicated by an arrow mark. The separation roller 53, tension roller 54, pressure roller 52, and auxiliary roller 55 are rotated by the circular movement of the fixation belt 57. The tension roller 54 provides the fixation belt 57 with a preset amount of tension.

As electric power is supplied to the halogen lamps 58 and 59, which are in the hollows of the fixation rollers 51 and pressure roller 52, respectively, the halogen lamps 58 and 59 generate heat. As a result, the fixation roller 51 and pressure roller 52 are heated from within, increasing therefore in surface temperature. The surface temperatures of the fixation roller 51 and pressure roller 52 are detected by unshown thermistors, and the detected surface temperatures are fed back to an unshown control circuit, which controls the amount by which electric power is supplied to the halogen lamps 58 and 59 so that the detected temperatures inputted from the thermistors remain at a preset level. In other words, the control circuit keeps the temperature of the fixation nip N at a preset level by keeping the surface temperatures of the fixation roller 51 and pressure roller 52 at the preset level.

The recording medium P, which is bearing an unfixed toner images on its surface, is conveyed from the transfer belt mechanism E to the fixing device F, is introduced into the fixation nip N between the fixation belt 57 and pressure roller 52, and is conveyed through the fixation nip N while remaining pinched by the fixation belt 57 and pressure roller 52. While the recording medium P is conveyed through the fixation nip N, the surface of the recording medium P, which is bearing the unfixed toner image(s), faces the surface of the fixation belt 57. The thermoplastic resin layer, as the surface layer, of the recording medium P are heated and pressed along with toner images thereon to soften and melt them. During this process, in order to properly soften the toner image(s) and the thermoplastic resin layer, as the surface layer, of the recording medium P, the temperature of the fixation belt 57 is maintained at a preset level, for example, 190° C., which is substantially higher than the glass transition temperature (which in this embodiment is roughly 50°) of the toner. Thus, the unfixed monochromatic toner images, different in color, on the recording medium P are melted, being thereby mixed, and eventually, they become fixed to the recording medium P. At the same time, the recording medium P is thoroughly adhered to the surface of the fixation belt 57.

Thereafter, as the fixation belt 57 is circularly moved further, the recording medium P is conveyed, while remaining thoroughly adhered to the fixation belt 57, through the cooling area R (cooling portion), which is between the fixation nip N and separation roller 53 in terms of the direction parallel to the recording medium conveyance direction. While the recording medium P is conveyed through this cooling area R, it is efficiently cooled by the air flow induced in an air duct 56*a* by the cooling fan 56 surrounded by the air duct 56*a*. The air flow induced by the cooling fan 56 is perpendicular to the surface of the recording medium P. With the employment of the above described structural arrangement, while the recording medium P is conveyed through the cooling area R, the recording medium P remains thoroughly adhered to the fixation belt 57 and the toner images thereon are cooled so that their temperatures fall below the glass transition temperature of the toner.

As described above, the recording medium P remaining thoroughly adhered to the fixation belt 57 is sufficiently cooled in the cooling area R, and then, is conveyed to the position of the separation roller 53 by which the fixation belt 57 is made to curve. As the fixation belt 57 is made to curve, the recording medium P is made to peel itself from the fixation belt 57 by its own rigidity; the recording medium P is separated from the fixation belt 57 by the interaction between the curvature of the fixation belt 57 and the rigidity of the recording medium P.

The auxiliary roller 55 prevents the recording medium P from becoming separated from the fixation belt 57 in the cooling area R, preventing thereby the toner images from being disturbed by the separation of the recording medium P from the fixation belt 57, and also, preventing it from becoming impossible for the recording medium P to be further conveyed.

The cooling means 56 does not need to be limited to a fan. Needless to say, the cooling means 56 may be of the contact type, for example, Peltier element, a heat pipe, or a cooling apparatus which recirculates water as cooling medium.

As described above, in order to obtain a high gloss image, the image heating system (combination of image heating apparatus and recording medium dedicated to formation of high gloss image, which will be described later) in this embodiment uses recording medium made up of a substrate layer formed of ordinary paper, and an image formation layer (image receiving layer; glossing layer) formed on the substrate layer, of thermoplastic resin. The surface of this image formation layer is the image transfer surface onto which the toner images are transferred.

While recording medium such as the above described one is conveyed through the fixation nip N while remaining pinched between the fixation roller 51 and fixation belt 57, the image formation layer of the recording medium is softened, along with the toner images thereon, by the heat from the fixation belt 57, and also, is subjected, along with the toner image thereon, to the internal pressure of the fixation nip N. As a result, the toner images are pressed into the hot resin layer. At the same time, the recording medium P is pressed upon the surface of the fixation belt 57, while being kept thoroughly in contact with the surface of the fixation belt 57. Thereafter, as the fixation belt 57 is circularly moved further, the recording medium P is conveyed through the cooling area R while being efficiently cooled by the forced-air cooling means and remaining thoroughly adhered to the fixation belt 57. Then, it is separated from the fixation belt 57 by the curvature of the fixation belt 57, in the area in which the fixation belt 57 is made to curve by the separation roller 53.

Figure 4A:
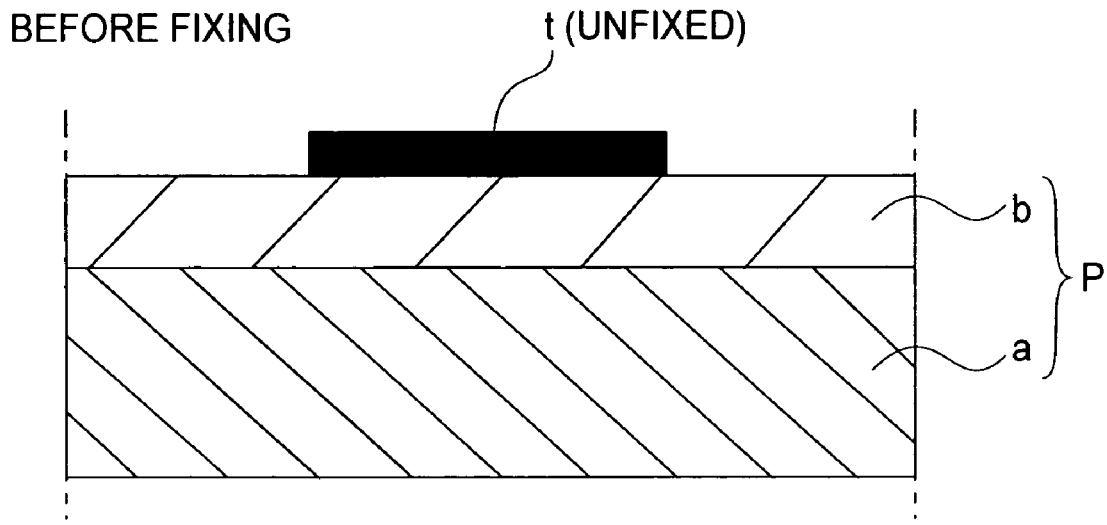
FIG. 4A is a schematic view of the recording medium prior to image fixation, showing the unfixed toner image borne on the toner image receiving layer of the recording medium.
Figure 4B:
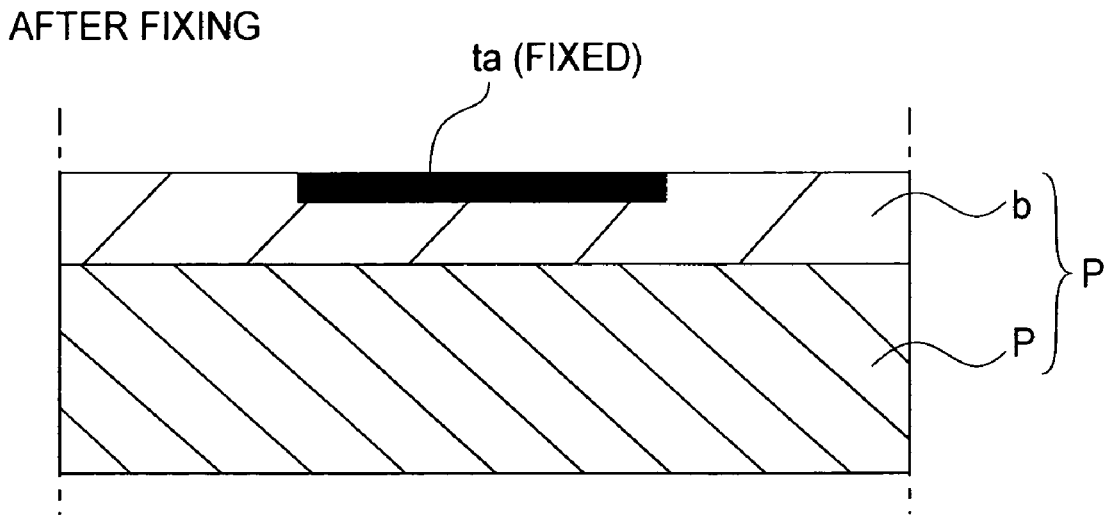
FIG. 4B is a schematic view of the recording medium after image fixation, showing the toner image thoroughly embedded in the toner image receiving layer of the recording medium.

FIG. 4(*a*) is a schematic view of the recording medium P before the fixation of the unfixed toner image t on the resin layer b of the recording medium P. FIG. 4(*b*) is a schematic view of the recording medium P after the toner image t thoroughly embedded in the resin layer became fixed. As the softened resin layer b of the recording medium P, into which the toner image t has been embedded, and which is remaining pressed on the surface of the fixation belt 57, is cooled down, the surface of the embedded toner image t, and the portion of the surface of the resin layer b, which surrounds the embedded toner image t, conform to the surface of the fixation belt 57, which is as smooth as the surface of a mirror, becoming thereby just as smooth as the surface of a mirror. Since the unfixed toner image t becomes fixed while remaining completely embedded in the resin layer b of the recording medium P, the resultant copy is smooth across the entirety of it surface. In other words, it is possible to obtain an excellent high gloss image.

The recording medium P is made up of a substrate layer a and a resin layer b. The substrate layer a is coated with, for example, a mixture of adhesive and pigment, as primary ingredients, across at least one of its surfaces. The resin layer b as the toner image receiving layer is primarily formed of thermoplastic resin, and is layered on the surface of the substrate layer a, which has been coated with the mixture of the adhesive and pigment.

The primary ingredients of the above described resin layer b (toner image receiving layer) are thermoplastic resin and thermosetting resin. The resin layer b may be made up of a mixture of the thermoplastic resin and thermosetting resin, or may be made up of multiple sublayers, inclusive of a thermoplastic layer, the primary ingredient of which is a thermoplastic, and a thermosetting layer, the primary ingredient of which is a thermosetting resin. However, when the toner image receiving layer b is made up of multiple sublayers, the outermost layer has to be the layer, the primary ingredient of which is a thermosetting resin. Further, the toner image receiving layer b may be made up of the combination of a sublayer formed of the mixture of a thermoplastic resin and a thermosetting resin, a sublayer formed of a thermoplastic resin, and a sublayer formed of a thermosetting resin. In this case, the outermost sublayer must be the sublayer formed of the mixture of thermoplastic and thermosetting resins, or the sublayer formed of a thermosetting resin.

As the material for the thermoplastic layer, polyester resin, styrene-acrylic ester, styrene-methacrylic ester, etc., can be used. However, polyester resin, which is the primary ingredient of the toner, is preferable for the following reason. That is, in order to ensure that as the recording medium P and the toner image thereon are subjected to heat and pressure in the fixing apparatus, the toner image bearing surface of the recording medium P and the toner image thereon fully conform to the surface of the fixation belt so that they become as smooth as the surface of the fixation belt, the fixing apparatus in this embodiment is structured so that not only the toner image on the recording medium, but also the resin layer b of the recording medium P are softened by the application of heat and pressure.

The recording medium P used in this embodiment, that is, the recording medium P, the surface layer of which is the resin layer b, is made up of the substrate layer a, which is a piece of coated paper with a basis weight of 170 g/m$^2$, and the resin layer b formed primarily of polyester (thermoplastic resin), on one of the surfaces of the substrate layer a. The resin layer b is transparent, and is 20 μm in thickness. The thickness of the transparent resin layer b is set so that the toner, which is 5-10 μm in average particle diameter, can be thoroughly embedded in the transparent resin layer b.

When a test piece was cut out of film formed of polyester resin, that is, the same substance as that used as the material for the abovementioned transparent resin layer b, and the coefficient of thermal expansion of the test piece was measure, the coefficient was $7\times10^{-5}$/° C. Incidentally, coefficient of thermal expansion may be referred to as coefficient of thermal contraction.

When a polyimide belt, which is employed by a belt-based fixing apparatus in accordance with the prior art, was used as the fixation belt 57, toner images were disturbed by the fixation belt 57, resulting in the formation of defective images, that is, images which are rough across their surfaces.

To describe in more detail, the toner image on the recording medium P had deviated in position as if it were stretched toward edges starting from the center. A further examination revealed the following: The recording medium P and fixation belt 57 contact each other in the fixation nip N, and are heated together by the fixation nip N as the heating portion, the temperature of which is kept at roughly 190° C. Thus, the temperature of the recording medium P (toner image thereon) increases to roughly 190° C. in the fixation nip N between the fixation roller 51 and pressure roller 52. Then, the recording medium P is conveyed to the cooling area R as the cooling portion, and is cooled while it is conveyed through the cooling area R. By the time it is conveyed to the adjacencies of the separation roller 53, it falls in temperature to roughly 40° C., and separates from the fixation belt 57. While the abovementioned temperature changes occur to the recording medium P and fixation belt 57, they expand due to the application of the heat, and contact due to the cooling by the cooling means.

The glass transition temperatures Tg of the toner and resin layer b are lower than 190° C. Thus, while the recording medium P is conveyed from the heating portion N to a certain point in the cooling area R, both the toner and resin layer b remain melted, and the recording medium P contracts, with the toner image on the recording medium P remaining in contact with the fixation belt 57. In other words, the recording medium P contracts, with the toner image thereon remaining almost fixed to the fixation belt 57. Further, the contraction of the recording medium P is greater than that of the fixation belt 57. Therefore, a defective image, that is, an image defective in that it appears as if the toner image were stretched toward its edge starting from the center, is yielded. The coefficient of expansion of this transfer belt, in accordance with the prior art, formed of polyimide was $4\times10^{-5}$/° C.

As for the method for testing the coefficient of thermal expansion, ASTM test method D696 can be used to measure the coefficient. However, this method requires that a test piece is greater in size than a certain value.

Thus, instead of the abovementioned method, the following method may be used to measure the coefficient of thermal expansion of a fixation belt. That is, two markings are placed with a preset distance on the fixation belt, and the coefficient of thermal expansion of this fixation belt is obtained as the ratio between the distance between the two markings while the fixation belt is kept in the heated condition, and that after the fixation belt is cooled.

While the recording medium P is conveyed through the fixation nip N, pressure is applied to the recording medium P while the recording medium P remains in contact with the fixation belt 57. The amount of this pressure is substantial, being likely to stretch the recording medium P. Further, the coefficient of thermal expansion of the recording medium P is affected by the amount of moisture in the recording medium P. Generally, a sheet of paper expands as it absorbs moisture, whereas it contracts as it dries. Moreover, a sheet of paper, which is sufficiently low in moisture content, displays a characteristic that resembles one of the characteristics of resin. That is, it expands as it is heated, and it contracts as it is cooled.

The observation of the test in which the recording medium P having the resin layer b was heat in an oven to examine the thermal expansion of the recording medium P revealed that the entirety of the recording medium P expands or contracts together with the resin layer b as the surface layer.

Thus, it is possible to think that the disturbance of a toner image on the recording medium P is attributable to the difference in the amount of contraction between the resin layer b of the recording medium P and the fixation belt 57. Thus, it is reasonable to think that the level of defectiveness, at which an image is fixed by a belt-based fixing apparatus, can be reduced by adjusting the fixation belt 57 in coefficient of thermal expansion.

In order to verify the above described hypothesis, the following experiments were carried out, in which the fixation belts 57 different in coefficient of thermal expansion were tested. More specifically, all the tested fixation belts 57 were mono-layer belts formed of siloxane-modified polyimide. They were rendered different in coefficient of thermal expansion by rendering them different in siloxane content. When one of these fixation belts 57 was used, no image defect occurred. This fixation belt formed of siloxane-modified polyimide was roughly 20% in siloxane content, and $8\times10^{-5}$/° C. in coefficient of thermal expansion.

Further, the mono-layer fixation belts, which were formed of siloxane-modified polyimide, and were different in siloxane content, were evaluated in image quality. The relationship between the six fixation belts different in coefficient of thermal expansion and the levels of defectiveness of their fixation performance are given in Table 1. As will be evident from the table, the siloxane content is desired to be in a range of 17-24%.

TABLE 1

| | Siloxane Content | Coefficient of Thermal Expansion | Image Evaluation |
|---|---|---|---|
| Belt 1 | 0 | 4 ($\times10^{-5}$/° C.) | N |
| Belt 2 | 17 | 6 | G |
| Belt 3 | 18 | 7 | E |
| Belt 4 | 20 | 8 | E |
| Belt 5 | 22 | 9 | E |
| Belt 6 | 24 | 10 | G |
| Belt 7 | 26 | 12 | N |

As for the evaluation of the image disturbance by the naked eye, E means the excellent level; G, the acceptable level; and N means the unacceptable level.

In an additional experiment, a fixation belt formed of stainless steel (SUS304) was tested. In this case, the level of quality at which images were fixed was very low. The coefficient of thermal expansion of this material was $1.5\times10^{-5}/°$ C.

From the results given above, it is evident that the preferable range for the coefficient of thermal expansion of the fixation belt 57 is no less than $6\times10^{-5}/°$ C. and no more than $10\times10^{-5}/°$ C.

The coefficient of thermal expansion of the resin layer b of the recording medium P is $7\times10^{-5}/°$ C. Therefore, it is desired that the following relationship is satisfied between the coefficient of thermal expansion of the fixation belt 57 and that of the resin layer b of the recording medium P: $0.85 \leqq X \leqq 1.4$ (X=coefficient of thermal expansion of fixation belt/coefficient of thermal expansion of resin layer of recording medium).

Further, according to experiments in which the changes in the ambience in which the fixing apparatus was used, and the changes in the properties of the recording medium P, were taken into consideration, the more preferable range for the coefficient of thermal expansion of the fixation belt 57 is no less than $7\times10^{-5}/°$ C. and no more than $9\times10^{-5}/°$ C. In the similar context, it is desired that the following relationship is satisfied between the coefficient of thermal expansion of the fixation belt 57 and that of the resin layer b of the recording medium P: $1.0 \leqq X \leqq 1.2$.

As will be evident also from the above results, the range of the coefficient of thermal expansion of the fixation belt 57, in which the toner image on the recording medium P is not disturbed, has the upper and lower limits. This means that it is not true that the greater the fixation belt 57 in coefficient of thermal expansion, the better, or the smaller the fixation belt 57 in coefficient of thermal expansion, the better. In other words, if the coefficient of thermal expansion (contraction) of the fixation belt 57 is very different from that of the recording medium P, the toner image is pulled by both the fixation belt 57 and recording sheet P. As a result, the toner image is disturbed.

An additional experiment, in which a mono-layer belt formed of PFA, which was $12\times10^{-5}/°$ C. in coefficient of thermal expansion, was used, confirmed that increasing the fixation belt 57 in coefficient of thermal expansion exacerbates this problematic phenomenon.

The above described phenomenon is one of the problematic phenomena which occur to a belt-based fixing apparatus structured so that the recording medium is separated from the fixation belt after it is cooled by a cooling means.

That is, the phenomenon does not occur to a roller-based fixing apparatus, which employs a fixation roller, the surface layer of which is formed of polyimide. The reason therefor is as follows: A fixation roller is smaller than a fixation belt, in the temperature changes which occurs between when it comes into contact with recording medium and when it becomes separated from the recording medium; the toner remains sufficiently hot, remaining therefore plastic, even after its separation from the fixation roller. Therefore, the toner heated by a fixation roller gradually solidifies while it naturally cools as the recording medium gradually contracts. In other words, the toner image settles in position in coordination with the contraction of the recording medium. Therefore, the image defect does not occur.

Incidentally, Japanese Laid-open Patent Application 2000-56602 proposes to use siloxane-modified polyimide as the material for the surface layer of a fixation roller. A roller-based fixing apparatus, such as the one disclosed in the above-mentioned patent application, is not structured to separate recording medium from the fixation roller after cooling the recording medium. Therefore, the phenomenon that the unfixed toner image on recording medium is disturbed by a fixing apparatus cannot occur.

In this embodiment, siloxane-modified polyimide was used as the material for the fixation belt 57. However, the material for the fixation belt 57 does not need to be limited to siloxane-modified polyimide. In other words, any resinous substance may be used as the material for the fixation belt 57 as long as the coefficient of thermal efficiency of the substance falls within the range specified by the present invention. Obviously, the usage of such a substance can offer the same results as those provided by this embodiment of the present invention.

For example, it seems reasonable to form the fixation belt 57 of the same polyester as that used as the material for the toner image receiving layer b (surface layer) of the recording medium P. However, the usage of this substance as the material for the fixation belt 57 creates new problems. For example, this substance is difficult to mold in the shape of a belt, or the recording medium P tends to remain adhered to a fixation belt formed of this substance, failing therefore to peeling away from the fixation belt 57. Furthermore, there are various requirements, in addition to the above described ones, which a fixation belt must meet from the standpoint of the rigidity, toner releasing property, and the like.

The siloxane-modified polyimide is easy to change in coefficient of thermal expansion, excellent in release property, and high in rigidity, being therefore one of the preferable materials for a fixation belt. Incidentally, fluorine-modified polyimide may be used as the material for a fixation belt, and the usage of this substance will offer the same results as those obtained by the usage of siloxane-modified polyimide.

As described above, by using, as the material for the fixation belt 57, one of the substances, the coefficient of thermal expansion of which are in the range specified by the present invention, it was possible to prevent the toner image on the recording medium P from becoming disturbed, and therefore, it was possible to obtain an excellent high gloss image.

Embodiment 2

Figure 6:
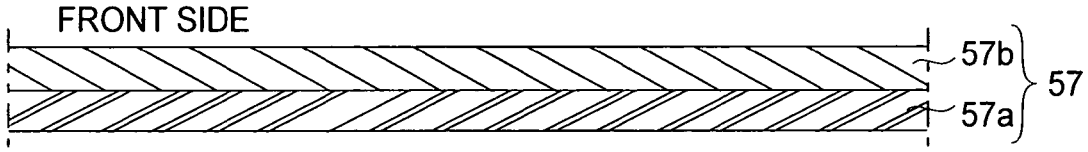
FIG. 6 is a schematic sectional view of the fixation belt in the second embodiment of the present invention.

In the case of the image forming apparatus in the first embodiment, a mono-layer belt formed of siloxane-modified polyimide was used as the fixation belt 57. Referring to FIG. 6, in this embodiment, a two-layer belt made up of a base layer 57*a* (substrate layer) formed of polyimide, and a surface layer 57*b* formed on the base layer 57*a* by coating siloxane-modified polyimide on the base layer 57*a*, as shown in FIG. 6, is used as the fixation belt 57. The surface of this coated layer 57*b* is the surface with which the resin layer of recording medium is placed thoroughly in contact.

The coefficient of thermal expansion of the fixation belt 57, in this embodiment, made up of two layers 57*a* and 57*b* is determined by the difference in coefficient of thermal expansion between the two layers 57*a* and 57*b*, and the rigidity, inclusive of thickness, of the fixation belt 57. Thus, the fixation belt 57 can be optimized in coefficient of thermal expansion by reducing the base layer 57*a* in thickness so that the coated layer 57*b* of the fixation belt 57 can be increased in thickness to optimize the fixation belt 57 in its overall coefficient of thermal expansion.

More specifically, the optimal thicknesses for the base layer 57*a* and coated layer 57*b* of the fixation belt 57 were determined by changing the thickness of the base layer 57*a* formed of polyimide, in a range of 50-200 μm, and the thickness of the coated layer 57*b*, in a range of 10-100 μm. Further, the amount by which siloxane was added to polyimide was varied to determine the proper value for the siloxane content for forming a belt, as the fixation belt 57, the coefficient of thermal expansion of which was in the range specified by the present invention. Testing of the thus obtained belt as the fixation belt 57 yielded the same results as those yielded by the fixation belt 57 in the first embodiment.

However, the addition of the base layer 57*a* formed of polyimide increased the fixation belt 57 in strength, yielding therefore an additional effect; the fixation belt 57 was extended in life.

As described above, in this embodiment, a belt, the coefficient of thermal expansion of which was in the range specified by the present invention, was employed as the fixation belt 57 for the fixing apparatus in which recording medium is separated from the fixation belt after being cooled. Therefore, the image forming apparatus did not output a defective image, the flaw of which is attributable to the positional deviation of the toner image which occurs during the fixation of the toner image; it was possible to obtain an excellent high gloss image.

Embodiment 3

Figure 7:
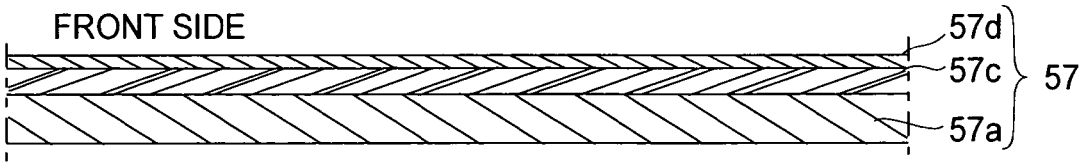
FIG. 7 is a schematic sectional view of the fixation belt in the third embodiment of the present invention.

Referring to FIG. 7, in this embodiment, a three-layer belt made up of a substrate layer 57*a* formed of polyimide, an elastic layer 57*c* formed on the substrate layer 57*a*, of silicon rubber, and a surface layer 57*d* as a release layer formed on the elastic layer 57*b* by coating PFA (copolymer of tetrafluoroethylene and perfluoroalkyl vinyl ether) on the elastic layer 57*b*, was used as the fixation belt 57.

Even if the fixation belt 57 has three layers, the overall coefficient of thermal expansion of the fixation belt 57 is determined by the coefficients of thermal expansion and rigidities of the three layers, which in this case are layers 57*a*, 57*c*, and 57*d*.

In the case of the fixation belt 57, in this embodiment, structured as described above, silicon rubber as the material for the elastic layer 57*c*, and PFA as the material for the release layer 57*d*, are relatively large in coefficient of thermal expansion. Therefore, in order to prevent these layers from contracting, the fixation belt 57 in this embodiment was adjusted in its overall coefficient of thermal expansion by increasing it in rigidity by increasing in thickness its substrate layer 57*a* formed of polyimide.

In order to obtain a belt, as the fixation belt 57, the coefficient of thermal expansion of which is in the range specified by the present invention, multiple three-layer belts different in the thickness of the elastic layer 57*c* and the thickness of the release layer 57*d* as the surface layer were produced to determine the proper thicknesses for the two layers 57*c* and 57*d*. The results of the tests of these fixation belts 57 were the same as those in the first embodiment.

The provision of the release layer 57*d* made it difficult for contaminants such as stray toner to adhere to the fixation belt 57, providing an additional effect; the fixation belt 57 was improved in terms of the level of ease with which the fixation belt can be cleaned.

As described above, in this embodiment, a belt, the coefficient of thermal expansion of which was in the range specified by the present invention, was employed as the fixation belt 57 for the fixing apparatus in which recording medium is separated from the fixation belt after being cooled. Therefore, the image forming apparatus did not output a defective image, the flaw of which was attributable to the positional deviation of the toner image which occurs during the fixation of the toner image; it was possible to obtain an excellent high gloss image.

Incidentally, in the first to third embodiments, the image heating apparatus was the fixing apparatus for fixing the unfixed toner image on recording medium. However, the present invention is also applicable to image heating apparatuses structured as follows. For example, the present invention is also applicable to an apparatus structured to reheat and re-press the toner image having been temporarily fixed to recording medium, in order to improve the toner image in glossiness.

Also in the first to third embodiments, the image forming portions employed such a multilayer transfer method that directly transferred toner images from the photosensitive drums onto the recording medium P borne on the transfer belt 7. However, the application of the present invention is not limited to an image forming apparatus of the above described type. For example, the present invention is also applicable to an image forming apparatus employing an intermediary transfer method in which the toner images formed on the photosensitive drums are temporarily transferred in layers onto an intermediary transferring member, and then, are transferred all at once from the intermediary transferring member onto recording medium. Obviously, not only is the present invention is applicable to a color image forming apparatus, but also, a black-and-while image forming apparatus.

As described above, by structuring an image heating apparatus as the fixing apparatuses in the above described embodiments of the present invention were structured, it is possible to reduce the difference in coefficient of thermal expansion between its fixation belt and the recording medium used with the apparatus. Therefore, it is possible to prevent the toner image on the recording medium from being disturbed by the difference in the amount of thermal expansion and contraction between the fixation belt and recording medium. Therefore, it is possible to obtain an excellent high gloss image, more specifically, an image which does not suffer from the defect attributable to the toner image disturbance.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 161294/2005 filed Jun. 1, 2005 which is hereby incorporated by reference.

What is claimed is:

1. An image heating apparatus for heating an image formed on a recording material having a resin material layer at an image formation side thereof, said apparatus comprising:

a belt for closely contacting and heating an image on the recording material to provide a high glossiness image; and a cooler for cooling the recording material heated by said belt;

wherein said belt comprises a layer of siloxane-modified polyimide and has a thermal expansion coefficient of not less than $6\times10^{-5}$/° C. and not more than $10\times10^{-5}$/° C.

2. An apparatus according to claim 1, wherein said belt has a thermal expansion coefficient of not less than $7\times10^{-5}$/° C. and not more than $9\times10^{-5}$/° C.

3. An apparatus according to claim 1, wherein said image is constituted by toner, and said belt heats the toner and the resin material layer to soften the toner and the resin material layer.

4. An apparatus according to claim 1, wherein said belt layer of siloxane-modified polyimide is a surface layer.

5. An apparatus according to claim 1, further comprising a heat roller for supporting and heating said belt, a heater for heating said heat roller, and a roller cooperative with said heat roller to form a nip between said roller and said belt.

6. A belt for use with an image heating apparatus for heating an image formed on a recording material having a resin material layer at an image formation side thereof, said belt comprising:

a contact layer for closely contacting and heating an image on the recording material to provide a high glossiness image;

wherein said belt is cooled by a cooler;

wherein said belt has a thermal expansion coefficient of not less than $6\times10^{-5}$/° C. and not more than $10\times10^{-5}$/° C.;

wherein said belt is a mono-layer of siloxane-modified polyimide.

7. An image heating apparatus for heating an image formed on a recording material having a resin material layer at an image formation side thereof, said apparatus comprising:

a belt for closely contacting and heating an image on the recording material to provide a high glossiness image;

a cooler, for cooling the recording material heated by said belt;

wherein a ratio of a coefficient of thermal expansion of said belt to that of the resin material layer of the recording material is not less than 0.85 and not more than 1.4;

wherein said belt is a mono-layer of siloxane-modified polyimide.

8. An apparatus according to claim 7, wherein the ratio is not less than 1.0 and not more than 1.2.

* * * * *